United States Patent [19]

Goto

[11] Patent Number: 4,557,119

[45] Date of Patent: Dec. 10, 1985

[54] CARRIAGE FOR A HAND-OPERATED SINGLE BED KNITTING MACHINE

[75] Inventor: Isamu Goto, Kodaira, Japan

[73] Assignee: Silver Seiko Limited, Tokyo, Japan

[21] Appl. No.: 605,269

[22] Filed: Apr. 30, 1984

[30] Foreign Application Priority Data

May 10, 1983 [JP] Japan ..... 58-68489[U]

[51] Int. Cl.[4] ..... D04B 7/12

[52] U.S. Cl. ..... 66/60 H; 66/64

[58] Field of Search ..... 66/60 R, 60 H, 64

[56] References Cited

U.S. PATENT DOCUMENTS 3,124,946 3/1964 Hiromatso ..... 66/60 H
3,153,922 10/1964 Bram ..... 66/64

FOREIGN PATENT DOCUMENTS 14473 3/1973 Japan .
896109 4/1980 U.S.S.R. ..... 66/60 R

*Primary Examiner*—Ronald Feldbaum
*Attorney, Agent, or Firm*—Ziems, Walter & Shannon

[57] ABSTRACT

A carriage for a hand-operated knitting machine is disclosed which is suitable for knitting with a thick or heavy yarn. A brush wheel is supported on a support plate for rotation substantially in a vertical or acutely inclined plane and extends at a lower end thereof between a sinker and a forward edge of a needle bed and below a lower face of a knitting needle in the needle bed so that it may push down loops suspended from the knitting needles.

4 Claims, 5 Drawing Figures

CARRIAGE FOR A HAND-OPERATED SINGLE BED KNITTING MACHINE

BACKGROUND OF THE INVENTION

1. Field of the Invention

This invention relates to a carriage for a hand-operated knitting machine, particularly for use with a thick yarn, and more particularly to a knitting carriage of the type wherein a pair of main cams are mounted at left and right symmetrical positions on a carriage base plate and a forward rest needle butt path is located forwardly of the main cams, whereby a tuck work can be knit with the carriage.

2. Description of the Prior Art

Generally, in knitting a tuck work with a thick knitting yarn such as a medium thick yarn or a very thick yarn on a hand-operated knitting machine for a thick yarn in which knitting needles are mounted in a 6 to 10 pitch (adjacent knitting needles are spaced by a distance of 6 to 10 mm) in a row, using a carriage having such a general construction as described above, a serious trouble has been often encountered: in particular, referring to FIG. 5 of the accompanying drawings, since loops 2, that is, tuck loops 2, extend in overlapping relationship across and over a knitting needle 1 introduced in a forward rest needle butt path and thus present a swelled condition as shown in FIG. 5, particularly a needle loop or loop 4 which are indirectly suspended from a knitting needle 3 adjacent the knitting needle 1 rise high at a position forwardly of a hook 5 of the knitting needle 3 while needle loops suspended from other knitting needles 3 may also rise but less high forwardly of the respective knitting needles 3. As a result, as the knitting needles are advanced by an auxiliary cam and a main cam, the hooks 5 of the knitting needles 3 stick into such loops 4 and accordingly they will come to carry the loops 4 doubly thereon.

In order to prevent such a trouble, a number of weights are often hung on a knit fabric to prevent rising of loops of the fabric. Since in such a case a knit fabric is pulled down strongly by weights, loops of the fabric are inclined to become tight, resulting in failure of a bulky appearance peculiar to a heavy yarn knit fabric.

Another arrangement for preventing rising of loops of a fabric is disclosed in Japanese utility model publication No. 38-14473 which employs a fabric pressing bar. In this arrangement, a fabric pressing bar is disposed such that, when a carriage is traversed on a needle bed, it is engaged with stems of knitting needles introduced in a forward rest needle butt path, and hence it is disadvantageous in that loops suspended from knitting needles adjacent the knitting needles cannot be pushed down at least below the stems of the knitting needles and hence the hooks of the knitting needles may stick into the loops so that the knitting needles may come to carry the loops doubly. Therefore, only 4, 3 and 2 successive tuck loops in a wale are normally possible in knitting a tuck work with a thick, very thick and extra thick yarn, respectively.

SUMMARY OF THE INVENTION

Accordingly, it is an object of the present invention to provide a carriage for a hand-operated single bed knitting machine which eliminates the defects of the conventional arrangements and enables knitting of a tuck work having successive tuck loops in a wale which are two or three times of successive tuck loops obtainable on a conventional knitting machine carriage.

According to the present invention, there is provided a carriage for a hand-operated single bed knitting machine of the type which includes a pair of main cams disposed in left and right symmetrical positions and an auxiliary cam mounted in contiguous relationship to each of said main cams for advancing a latch needle mounted in a needle bed of the machine from a retracted position within said needle bed to an intermediate position in which the latch needle extends across a gap between adjacent sinker elements and a forward edge of said needle bed, wherein it comprises means disposed forwardly of each of the auxiliary cams for pushing down a loop or loops suspended from another loop carried on a hook of the latch needle while the latch needle is advanced from said retracted to said intermediate position. By this construction, needle loops suspended indirectly from knitting needles, that is, needle loops positioned below needle loops carried on hooks of the knitting needles, can be pushed down below stems of the knitting needles so that the knitting needles may not stick into the loops.

A preferred embodiment of the present invention will be described in detail with reference to the accompanying drawings.

DETAILED DESCRIPTION OF THE INVENTION

Figure 1:
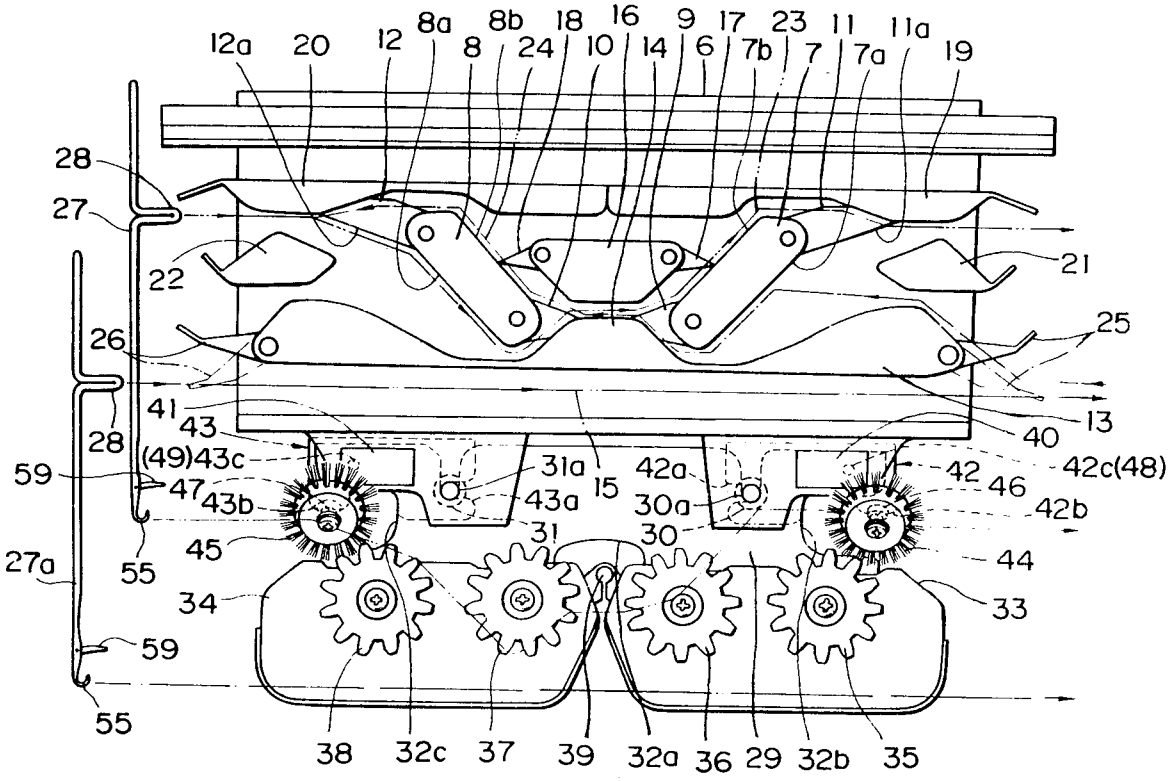
FIG. 1 is a bottom view of an embodiment of a carriage according to the present invention.

Referring to FIGS. 1 to 4, a carriage includes a carriage base plate 6 having a laterally elongated configuration, a pair of main cams 7 and 8 mounted at left and right symmetrical positions on a central portion of a lower face of the carriage base plate 6 and each having an outer or front advancing cam edge 7*a* or 8*a* and an inner or rear retracting or knitting cam edge 7*b* or 8*b*, and two pairs of auxiliary cams 9, 10 and 11, 12 mounted for pivotal motion at front and rear ends of the main cams 7 and 8, respectively.

The carriage further includes a laterally elongated front plate cam 13 located forwardly of the main cams 7, 8 and extending across the left and right opposite ends of the carriage base plate 6. The plate cam 13 has a generally trapezoidal retracting cam 14 integrally formed at an inside portion thereof between the front ends of the main cams 7 and 8. A front rest needle butt path 15 is defined by and located in front of a front edge of the plate cam 13.

A reversed trapezoidal fixed cam 16 is mounted at a central position between the main cams 7, 8 and in opposing relationship to the retracting cam 14, and a further pair of auxiliary cams 17 and 18 are mounted for pivotal motion at opposite rear corners of the fixed cam 16 and are urged into engagement with the knitting cam edges 7*b* and 8*b* of the main cams 7 and 8, respectively, each by means of a spring not shown.

A pair of laterally elongated plate cams 19 and 20 are mounted at laterally symmetrical positions rearwardly of the main cams 7 and 8, respectively, and generally extend in parallel relationship to the plate cam 13 between the left and right opposite ends of the carriage base plate 6. The aforementioned auxiliary cams 11 and 12 are normally resiliently urged into engagement with the plate cams 19 and 20 by means of individually associated springs not shown, as in a conventional knitting carriage.

A pair of generally diamond-shaped separating cams 21 and 22 are mounted at left and right symmetrical positions outwardly of the main cams 7 and 8 between the front plate cam 13 and the rear plate cams 19, 20, respectively.

Thus, a pair of knitting butt paths 23 and 24 for guiding a butt 28 of a knitting or latch needle 27 are provided in laterally symmetrical relationship relative to the center of the carriage by various cams including the main cams 7, 8 between the front plate cam 13 and the rear plate cams 19, 20.

A pair of opening and closing cams 25 and 26 are mounted for pivotal motion at left and right opposite ends of the front plate cam 13 and are each displaceable between an opening position (shown in full lines in FIG. 1) in which it opens the forward rest needle butt path 15 and a closing position (shown in phantom in FIG. 1) in which it closes the forward rest needle butt path 15. When the opening and closing cam 25 or 26 is in the opening position, a butt 28 of a latch needle or knitting needle 27*a* advanced to a forwardmost rest position will be guided into the front rest needle butt path 15 by the same. On the contrary, when the opening and closing cam 25 or 26 is in the closing position, it will be engaged by and guide the butt 28 of such needle 27 into the knitting butt path 23 or 24.

An arm 29 substantially in the form of a laterally elongated plate is removably mounted on a front side of the carriage base plate 6 by means of thumb wheels 30, 31. The arm 29 has substantially U-shaped recessed cutouts 32*a*, 32*b* and 32*c* formed at a central front side and left and right opposite sides thereof. The arm 29 further has a pair of left and right substantially L-shaped bent support portions 29*a* and 29*b* on a front side thereof, and a pair of pressers 33 and 34 are mounted in laterally symmetrical relationship at lower ends of the support portions 29*a* and 29*b* of the arm 29, respectively.

Two pairs of fabric gears 35, 36 and 37, 38 are mounted for rotation on lower faces of the pressers 33 and 34, respectively, and a yarn feeder 39 is located below the central recessed cutout 32*a* of the arm 29.

A pair of latch erecting magnets 40 and 41 are mounted at left and right positions of the lower face of a front part of the carriage base plate 6.

A pair of brush wheels 44 and 45 are disposed at lateral positions forwardly of the rear auxiliary cams 11 and 12 and are mounted for rotation on a pair of substantially laterally elongated rectangular support plates 42 and 43, respectively. Each of the support plates 42, 43 has a substantially U-shaped recessed cutout 42*a* or 43*a* formed along an inner side thereof, and a round hole 42*c* or 43*c* for positioning thereof formed at a portion adjacent an outer side thereof. Each of the support plates 42, 43 further has an integral bent shaft fixing portion 42*b* or 43*b* which extends obliquely downwardly from a portion adjacent an outer end thereof.

The brush wheel 44 is mounted for rotation on the shaft fixing portion 42*b* of the support plate 42 by means of a shaft 46 while the brush wheel 45 is mounted for rotation on the shaft fixing portion 43*b* of the support plate 43 by means of a shaft 47.

The support plates 42, 43 are placed on an upper face of the arm 29 with the brush wheels 44, 45 thereof positioned within the recessed cutouts 32*b*, 32*c*, respectively, and also with the round holes 42*c*, 43*c* thereof fitted around projections 48, 49 respectively, formed on the upper face of the arm 29 while the recessed cutouts 42*a*, 43*a* thereof are engaged with threaded rods 30*a*, 31*a* of the thumb wheels 30, 31. In this condition, the thumb wheels 30, 31 are operated so that the support plates 42, 43 are removably mounted on the arm 29. Thus, the brush wheels 44, 45 are held in their operative positions wherein each of the brush wheels 44, 45 is rotatable within a plane which is forwardly inclined by an angle of about 20 degrees relative a plane perpendicular to an axis of the stem of the knitting needle 27 and a lower end of the brush wheel 44 or 45 extends at least to a position a little below the stem of the knitting needle 27 and between a sinker 52 and a forward edge of a forward extension plate 51 of a needle bed 50.

In knitting a tuck work on the knitting machine, selected ones 27*a* of knitting needles 27 are first advanced to the forward rest needle position in accordance with a desired needle selection pattern, and a thick knitting yarn 53 is threaded through the yarn feeder 39 while the opening and closing cams 25 and 26 are set to the respective opening position thereof. In this condition, the carriage base plate 6 is moved on the needle bed 50. As the carriage is traversed several times, a corresponding number of yarn segments or loops 53 extend across and are accumulated on the stem of each of the knitting needles 27*a* in the forward rest needle position so that they may swell above the stem of the knitting needle 27*a*. As a result, a loop 54 particularly suspended from a knitting needle which is positioned adjacent the knitting needle 27*a* and is guided along the knitting butt path 23 or 24, or more particularly, a loop 54 through which a loop 56 carried on the hook 55 of the knitting needle 27 is drawn, may swell, in front of the hook 53 of the knitting needle 27, further high above the knitting needle 27.

Figure 2:
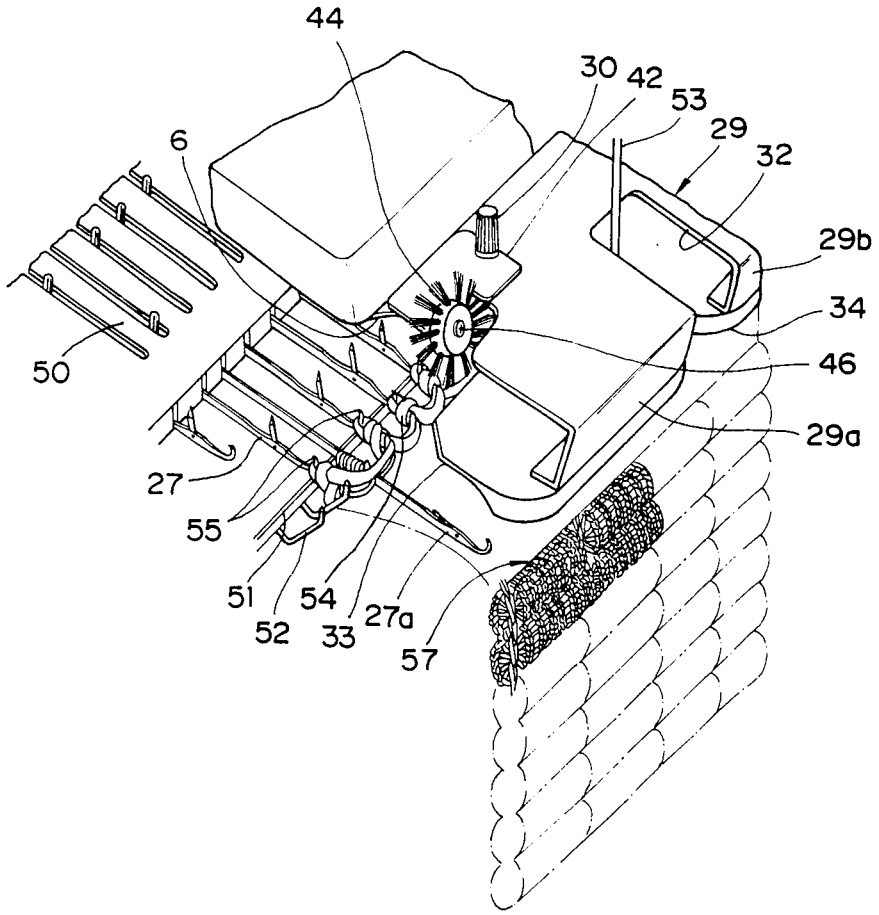
FIG. 2 is a perspective view showing part of the carriage of FIG. 1 in its knitting condition.
Figure 3:
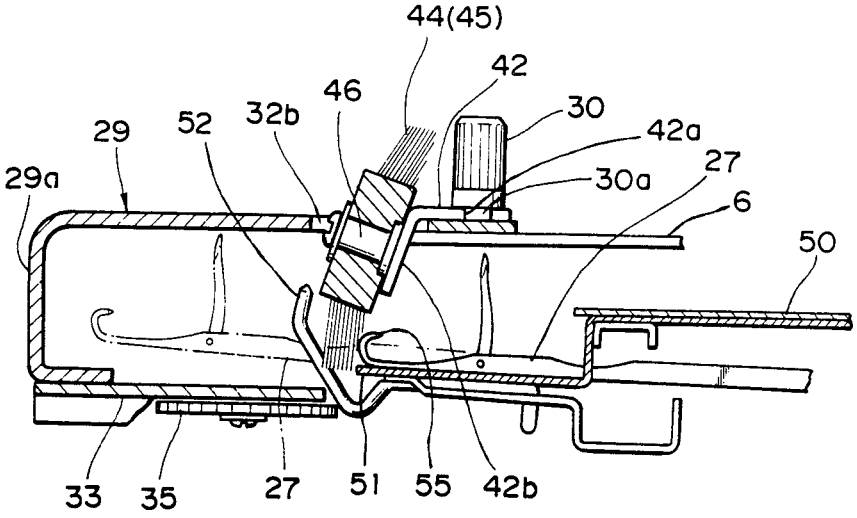
FIG. 3 is a side elevational sectional view of part of the carriage of FIG. 1 showing a brush wheel in use.
Figure 4:
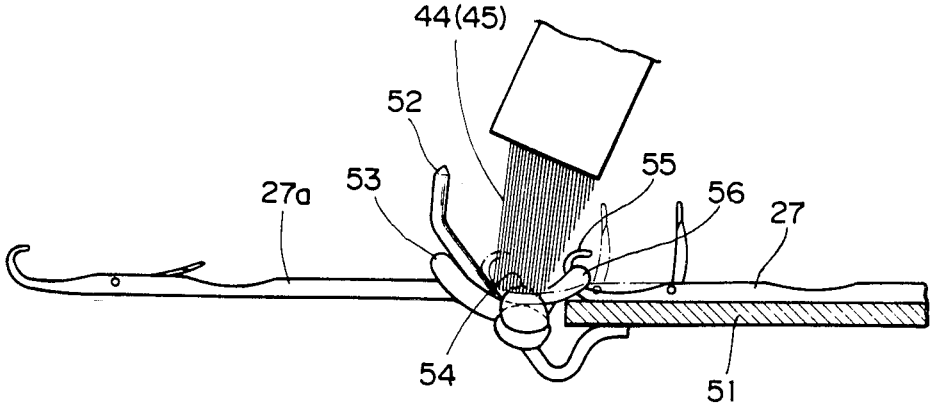
FIG. 4 is an enlarged side elevational sectional view showing the brush wheel of FIG. 3 in use.
Figure 5:
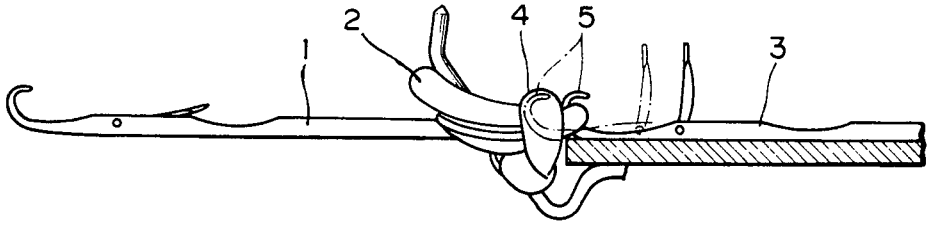
FIG. 5 is a side elevational view of part of a conventional knitting machine showing loops during knitting of a tuck work.

However, when the knitting needle 27 is advanced from a retracted position within the needle bed 50 as shown in full lines in FIG. 4 to an intermediate position in which the knitting needle 27 extends across a gap between adjacent sinkers 52 and the forward edge of the forward extension 51 of the needle bed 50 as shown in phantom in FIG. 4 by means of an advancing cam edge 12*a* (FIG. 1) of the rear auxiliary cam 11 or 12, a lower end of the brush wheel 44 or 45 is engaged with and forcibly pushes down the loop 54 substantially below the bottom edge of the stem of the knitting needle 27 (FIG. 4). Accordingly, the knitting needle 27 is thereafter advanced over the thus lowered loop 54 by the advancing cam edge 8*a* of the main cam 7 or 8 to clear the needle loop 56 over a latch 59 onto the stem of the knitting needle 27, and as a result, the hook 55 of the knitting needle 27 will not stick into the loop 54 at all. Hence, for example, by knitting a tuck work having up to nine successive tuck loops in a wale as shown in FIG. 2, a knit fabric 57 having a bulky appearance similar to a shirring work can be obtained.

Tuck works have been actually tried using various thick knitting yarns, and it has been found that up to 12, 8 and 5 successive tuck loops are possible with a medium thick yarn, a very thick yarn and an extra thick yarn, respectively.

In knitting other works than a tuck work on the knitting machine, the support plates 42, 43 are preferably removed from the arm 29 so that the brush wheels 44, 45 may not cause a trouble in knitting.

What is claimed is:

1. In a carriage for a hand-operated, single flat needle bed knitting machine of the type which includes a pair of main cams disposed in left and right symmetrical positions and an auxiliary cam mounted in contiguous relationship to each of said main cams for advancing a latch needle mounted in a single flat needle ed of the machine from a retracted position within said needle bed to an intermediate position in which the latch needle extends across a gap between adjacent sinker elements and a forward edge of said needle bed, the improvement which comprises a brush wheel having hairs mounted radially from an outer circumference thereof, and means for mounting said brush wheel for rotation in a plane substantially perpendicular to a longitudinal axis of the latch needle and in a position forwardly of each of said auxiliary cams in which position a lower portion thereof extends into said gap to push down a loop or loops suspended from another loop carried on a hook of the latch needle while the latch needle is advanced from said retracted to said intermediate position.

2. A carriage as claimed in claim 1, wherein said means for mounting includes a support plate removably mounted on said carriage.

3. A carriage as claimed in claim 2, wherein said support plate is removably mounted on said carriage by means of a threaded thumb wheel.

4. A carriage as claimed in claim 1, wherein said plane is inclined an angle of about 20 degrees relative to a plane perpendicular to the longitudinal axis of the latch needle.

* * * * *

UNITED STATES PATENT AND TRADEMARK OFFICE

CERTIFICATE OF CORRECTION

PATENT NO. : 4,557,119

DATED : December 10, 1985

INVENTOR(S) : ISAMU GOTO

It is certified that error appears in the above-identified patent and that said Letters Patent is hereby corrected as shown below:

Column 5, line 16, change "ed" to --bed--.

Signed and Sealed this

*Twentieth* Day of *May 1986*

[SEAL]

*Attest:*

DONALD J. QUIGG

*Attesting Officer*

*Commissioner of Patents and Trademarks*